US005816050A

United States Patent [19]

Sjunnesson et al.

[11] Patent Number: 5,816,050

[45] Date of Patent: Oct. 6, 1998

[54] LOW-EMISSION COMBUSTION CHAMBER FOR GAS TURBINE ENGINES

[75] Inventors: Anders Sjunnesson; Patrik Johansson, both of Trollhattan; Alf Andersson, Oxie; Sonny Lundgren, Malmo; Rolf Gabrielsson, Vanersborg, all of Sweden

[73] Assignee: Volvo Aero Corporation, Trollhattan, Sweden

[21] Appl. No.: 750,817

[22] PCT Filed: Jul. 13, 1994

[86] PCT No.: PCT/SE94/00689

§ 371 Date: Mar. 13, 1997

§ 102(e) Date: Mar. 13, 1997

[87] PCT Pub. No.: WO96/02796

PCT Pub. Date: Feb. 1, 1996

[51] Int. Cl.[6] ..... F02C 3/00; F23R 3/14; F23R 3/34

[52] U.S. Cl. ..... 60/748; 60/737; 60/732; 60/733

[58] Field of Search ..... 60/732, 733, 737, 60/738, 748, 750

[56] References Cited

U.S. PATENT DOCUMENTS

| | | | |
|---|---|---|---|
| 4,069,029 | 1/1978 | Hudson . | |
| 4,260,367 | 4/1981 | Markowski et al. | 60/732 |
| 4,301,657 | 11/1981 | Penny | 60/748 |
| 5,069,029 | 12/1991 | Kuroda et al. | 60/737 |
| 5,319,935 | 6/1994 | Toon et al. | 60/748 |
| 5,490,380 | 2/1996 | Marshall | 60/733 |

FOREIGN PATENT DOCUMENTS

| | | |
|---|---|---|
| 2 673 705 | 3/1991 | France . |
| 3819898 | 12/1989 | Germany . |
| 1 478 934 | 6/1977 | United Kingdom . |
| WO 92/07221 | 4/1992 | WIPO . |

*Primary Examiner*—Timothy Thorpe
*Assistant Examiner*—Ted Kim
*Attorney, Agent, or Firm*—Law Office Pollock, Vande Sande & Priddy

[57] ABSTRACT

A low-emission combustion chamber for gas turbine engines comprises an outer casing with an upstream end wall with a pilot fuel injector, a first flow swirler, an igniting members for initiating a stable diffusion frame in a pilot zone, at least one second coaxial swirler, main fuel injectors, secondary air inlets, and a main combustion zone. For obtaining a still further reduced emissions of primarily nitrogen oxides, the pilot zone is confined radially outwardly by a surrounding wall which constitutes the radially inner confinement of an axial outlet portion of a radial vaporization channel within the second swirler and a third radial flow swirler is adapted to supply the secondary air in a rotary motion opposite to that of the main flow of fuel and air.

6 Claims, 1 Drawing Sheet

LOW-EMISSION COMBUSTION CHAMBER FOR GAS TURBINE ENGINES

FIELD OF THE INVENTION

The present invention relates to a low-emission combustion chamber for gas turbine engines comprising an outer casing with a closing upstream end wall in which is mounted a pilot fuel injector. Spaced coaxially around the mouth of the injector is mounted a first radial flow swirler adopted to bring air radially entering therethrough to rotate around the longitudinal axis of the combustion chamber and to be mixed with injected pilot fuel and the mixture to be ignited by an igniting means to initiate a stable diffusion flame in a pilot zone. At least one second coaxial swirler is being arranged radially outwardly of the zone for bringing primary air radially entering through the second swirler and intended for the main combustion, to rotate around the longitudinal axis and to be mixed with fuel from main fuel injectors circumferentially spaced around the second swirler. To this fuel-air-mixture second air is then added for finishing the combustion in a subsequent main combustion zone.

BACKGROUND OF THE INVENTION

Gas turbine engine combustion chambers are previously known from e.g. WO 92/07221 and U.S. Pat. No. 4,069,029. Recently it has become still more important not only to reduce the emissions of carbon monoxide and unburnt hydrocarbon from combustion engines but also the emissions of nitrogen oxide. Particularly for reducing the last-mentioned a very exact and sensitive control of the entire combustion process in the combustion chamber is required. A large amount of various measures and design improvements have been suggested which imply considerable reductions of the harmful emissions of the engines but in the near future the limit values for the emissions will be further lowered stepwise and therefore still more refined control measures for the combustion process are now required. The techniques known up to now do not provide for this and therefore further improvements are necessary.

SUMMARY OF THE INVENTION

The object of the present invention therefore is to suggest a low-emission gas turbine combustion chamber of the kind referred to, in which a still further improved combustion process can be obtained thereby provide for still more reduced emissions, particularly of undesirable nitrogen oxides. According to the invention this is now made possible by the fact that the pilot zone is confined radially outwardly by a surrounding wall which at the same time constitutes the radially inner confinement of an axial outlet portion of a radial vaporization channel located inwardly of the second swirler and adapted to provide the vaporization of the injected main fuel, and because a third radial flow swirler is located axially approximately at the level of the downstream edge of the pilot zone wall and adapted to supply in a mixing zone the secondary air in a rotary motion opposite to that of the main flow of the fuel and air around the longitudinal axis.

In the two above-mentioned patent specifications, as a basic measure in order to reduce particularly the emissions of $NO_X$, the step has been taken to divide the combustion process into several stages axially following after each other. By a detailed control of each single step it has been considered that the combustion could be better controlled and as the result the emission of harmful components reduced. By supplying the air required for the combustion in several steps the combustion temperature can be kept relatively low which is a basic prerequisite for low emissions of nitrogen oxide.

The present invention, however, is based on the concept that as far upstream as possible in the combustion chamber there is to provide such a complete and homogenous mixture of fuel and air ignited by an exactly controlled combustion process in a pilot zone, that the combustion is compiled at still at a relatively low combustion temperature within the main combustion zone without division into several axially separated stages.

BRIEF DESCRIPTION OF THE DRAWINGS

By way of example, the invention will be further described below with reference to the accompanying drawing in which.

DETAILED DESCRIPTION OF THE PREFERRED EMBODIMENTS

Figure 1:
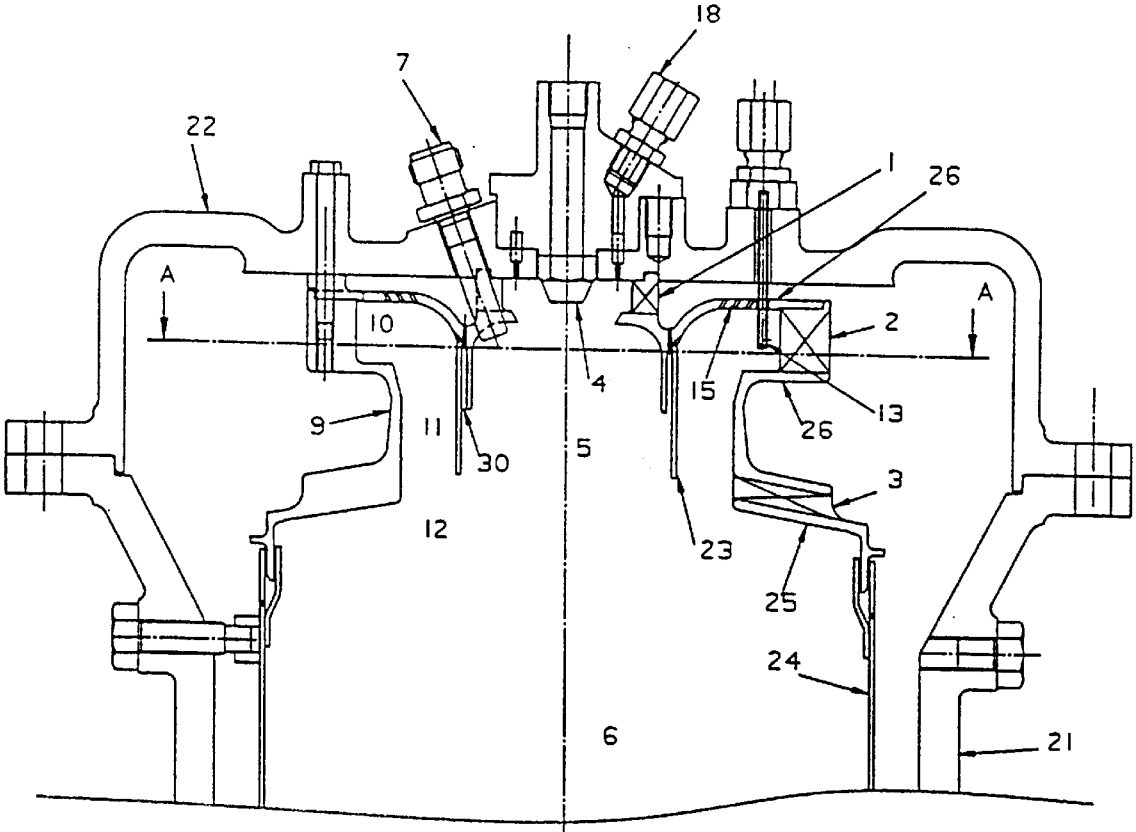
FIG. 1 is a longitudinal section through an inventive combustion chamber and FIG. 2 is a cross-sectional view through the combustion chamber taken along the line A—A in FIG. 1.

As shown in the drawings, the low-emission combustion chamber according to the invention comprises a pilot fuel injector 4 centrally mounted in a wall 22 which closes the upstream end of a surrounding outer casing 21. The casing 21 can be of cylindrical shape or have a can-annular shape in which a plurality of combustion chambers are arranged circumferentially spaced around a central axis. Spaced around the mouth of the pilot fuel injector 4 a first swirler 1 is coaxailly mounted. The first swirler is adapted to bring air flowing inwardly radially therethrough from the surrounding area closest inside the casing 21 and the end wall 22 to rotate around a combustion chamber longitudinal axis X. Pilot fuel injected in a known manner through the injector 4 is mixed with the rotary air and ignited by means of an igniting means 7 for initiation of a stable diffusion flame in a pilot zone 5.

Radially outwardly of the pilot zone 5 is located at least one second coaxial radial flow swirler 2 through which the primary air is introduced for the main combustion, and which then also is brought to rotate around the longitudinal axis X of the combustion chamber. At the swirler 2 are mounted main fuel injectors 13 and to the fuel-air-mixture thus obtained is then added secondary air and the combustion is finished in a subsequent main combustion zone 6.

Figure 2:
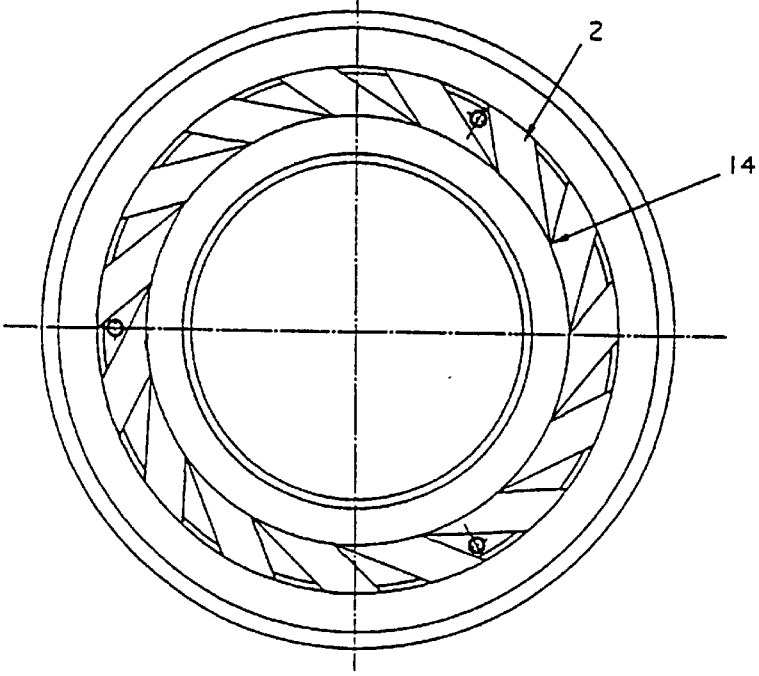

According to the invention, the pilot zone 5 now is radially outwardly confined by a surrounding wall 23 which at the same time constitutes a radial inner confinement of an axial outlet portion 11 of a radial vaporizing channel 9. The channel is located internally of the second swirler 2 and adapted to provide a vaporization of the main fuel from the injectors 13. According to the invention a third swirler 3 is furthermore adapted to supply secondary air from the surrounding area closest inside the outer cases 21 and end wall 22. The swirler 3 is located axially approximately at the level of the downstream edge of the pilot zone wall 23 and the vanes are arranged such that the flow of secondary air is given a rotary motion opposite that of the main flow of fuel and air around the longitudinal axis X in a mixing zone 12. Suitably, the third swirler 3 is mounted on an annular end wall 25 of a flame tube 24 which surrounds the main combustion zone 6. As is evident from FIG. 2 each of the vanes of the second swirler 2 has a cross sectional shape like a wedge or a triangle with one side located on the outer peripheral contour of the swirler with and the other two sides running out into an internal sharp edge.

For introduction of air into the boundary layer at one of or both the radially directed walls 26 carrying the vanes of the second swirler 2 and therefore a reduction of the flow friction thereagainst small apertures 15 might be made in the walls for the introduction of air.

After finished combustion in the main combustion zone 6 the exhaust gases continue their motion outwardly of the Figure and into the turbine.

The advantages of the combustion chamber and the operational manner thereof are the following. The pilot zone 5 allows that in operation the combustion in the main combustion zone 6 can be initiated and stabilized. Although the pilot flame is not required as such in order to stabilize the combustion in the main combustion zone the combustion can be made under leaner conditions and this is of course advantageous in many cases from the emissional point of view. Another advantage of the pilot zone 5 is that a reliable ignition can be obtained even in low fuel-and-air proportions in total, which is extremely important in certain engine applications. The location of the pilot zone 5 within the combustion chamber further implies that the igniting means or spark plug 7 can be mounted from the end wall which also is the case with the fuel injectors and this provides for good accessibility and therefore simplified maintainance. If required the wall 23 which confines the pilot zone 5 can be provided with film cooling by introduction of air through a cooling gap 30.

The vaporization channel 9 consists of three portions, namely a first radial portion 10, an axial portion 11 connected therewith and a third portion 12 for introduction of air from the third swirler 3. Into the radial portion 10 liquid fuel is injected fuel from the main fuel injectors 13. In the radial portion 10 the air is heavily rotated by the power impulse from the vanes of the swirler 3 and carry the fuel droplets along, the heavy rotation is a known manner subjecting the droplets to a continuous acceleration outwardly from the center, which is counter-balanced by an aerodynamic force directed towards the center. At a selected critical droplet diameter a perfect balance is obtained. Should the droplets be smaller than the critical diameter, they will be transported radially inwardly and out into the axial portion 11 of the vaporization channel. Should the droplets be greater, the inertia forces will be predominant and the droplets then will be transported radially outwardly and finally hit the edges 14 of the vanes of the swirler 2. There the liquid fuel will be retarded and form a film of liquid which successively is transported outwardly to the edges of the vanes. When the fuel film reaches the edges, it will be disintegrated again into small droplets by heavy shear against the rapid flow of air between the vanes. As a result the fuel droplets will be brought to stay within the radial portion 10 of the vaporization channel till they have been vaporized or disintegrated into a diameter which is smaller than the critical. The result thereof is that the fuel can be vaporized during short residence times for the gaseous part of the fuel-air mixture at low and high air temperatures, respectively, which is advantageous since it is important to avoid spontaneous ignition of the mixture at the same time as the fuel still must manage to be vaporized. This pre-mixture can thus be made lean.

In the subsequent axial portion 11 of the vaporization channel then the vaporization is then completed of such droplets which are smaller than the critical droplet diameter. The gas flow in the portion 11 also assists in cooling the partition wall 23 from the pilot zone 5.

Finally, the fuel-air mixture is mixed into correct stoichiometric value by supply of air from the swirler 3, this air not only diluting the mixture but also giving the same such a turbulent motion that possible inhomogenities in the fuel-air distribution from the exit of the axial channel portion 11 will be equalized.

In the above, the combustion chamber has been described in connection with the use of liquid fuels. However, it is also possible to use injectors or spreaders for gaseous fuels such as natural gas which provides for the use of the low-emission combustion chamber both for gaseous and diesel fuels with continuous interchanges therebetween during operation. Gaseous main fuel then is injected at about the same position at the swirler 2 as for liquid fuel but by a larger number of spreaders since no equalizing effect can be obtained by two-phase flow.

We claim:

1. A low-emission combustion chamber for gas turbine engines comprising an outer casing with a closing upstream end walls, a pilot fuel injector mounted therein a first radial flow swirler mounted spaced coaxially around a mouth of the injector and adopted to bring air radially entering therethrough to rotate around a longitudinal axis of the combustion chamber and to be mixed with injected pilot fuel, an igniting means for igniting the mixture to initiate a stable diffusion flame in a pilot zone, at least one second coaxial swirler arranged radially outwardly of said zone for bringing primary air radially entering through said second swirler and intended for the main combustion, to rotate around said longitudinal axis and to be mixed with fuel from main fuel injectors circumferentially spaced around said second swirler, to which fuel-air-mixture is then added secondary air for completing the combustion in a subsequent main combustion zone wherein the pilot zone is confined radially outwardly by a surrounding wall which also constitutes a radially inner confinement of an axial outlet portion of a radial vaporization channel located inwardly of said second swirler and adapted to provide the vaporization of the injected main fuel, and wherein a third radial flow siwrler is located axially approximately at a level of the downstream edge of said pilot zone wall and is adapted to supply in a mixing zone said secondary air in a rotary motion opposite to that of the main flow of fuel and air around the longitudinal axis.

2. A combustion chamber according to claim 1 wherein each of the vanes of the second swirler has a wedge-like or triangular shape in cross section with one side at an outer peripheral contour and the other two sides running out into a sharp edge.

3. A combustion chamber according to claim 2 wherein the third swirler is located at the upstream side of an annular end wall of a flame tube surrounding the main combustion zone.

4. A combustion chamber according to claim 1 wherein in at least one of the two radially directed walls which support the vanes of the second swirler are arranged small apertures for the introduction of air into a boundary layer of the wall and thus a reduction of the friction thereagainst.

5. Combustion chamber according to claim 2, wherein in at least one of the two radially directed walls which support the vanes of the second swirler are arranged small apertures for the introduction of air into the boundary layer of the wall and hence a reduction of the friction thereagainst.

6. Combustion chamber according to claim 3, wherein in at least one of the two radially directed walls which support the vanes of the second swirler are arranged small apertures for the introduction of air into the boundary layer of the wall and hence a reduction of the friction thereagainst.

* * * * *